US005743384A

United States Patent [19]

Clark

[11] Patent Number: 5,743,384

[45] Date of Patent: Apr. 28, 1998

[54] SELF-LEVELING KEY SWITCH

[75] Inventor: Neal S. Clark, Spokane, Wash.

[73] Assignee: Key Tronic Corporation, Spokane, Wash.

[21] Appl. No.: 853,712

[22] Filed: May 9, 1997

[51] Int. Cl.[6] ..... H01H 13/70

[52] U.S. Cl. ..... 200/344; 200/513; 200/341

[58] Field of Search ..... 200/513, 344, 200/512, 520, 341, 342, 343, 345, 515, 5 A

[56] References Cited

U.S. PATENT DOCUMENTS

| | | | |
|---|---|---|---|
| 3,916,150 | 10/1975 | Abernethy et al. | 200/340 |
| 4,190,748 | 2/1980 | Langford | 200/5 A |
| 4,559,427 | 12/1985 | Dolson et al. | 200/159 B |
| 4,786,766 | 11/1988 | Kobayashi | 200/5 A |
| 5,115,106 | 5/1992 | Weiland et al. | 200/513 |
| 5,247,143 | 9/1993 | Suwa | 200/517 |
| 5,376,765 | 12/1994 | Holmes et al. | 200/344 |
| 5,386,091 | 1/1995 | Clancy | 200/512 |

*Primary Examiner*—David J. Walczak

*Attorney, Agent, or Firm*—Wells, St. John, Roberts, Gregory & Matkin P.S.

[57] ABSTRACT

A low cost self-leveling keyswitch 10 having a keytop 32 with an elongated keycap 34 that extends in a major direction. The keytop 32 has an off-set keystem 36 that is slidably mounted in a keystem bearing 26. The keytop 32 has a self-leveling projection 42 that extends downward, spaced from the keystem 36. Both the keystem 36 and the projection 42 are on opposite sides of the central axis 33 and engage an elongated plateau portion 66 of an elastomeric dome return spring 60. The elongated direction of the plateau portion is the same as the elongated direction of the keycap 34. The elongated dome return spring 60 in conjunction with the self-leveling protection 42 minimize any wobble or tilting of the keytop 32 as the keytop 32 is depressed independently of the location of the depression force. The effective size of the projection 42 is preferably more than 50% of the effective area of the elongated dome return spring 60.

9 Claims, 3 Drawing Sheets

SELF-LEVELING KEY SWITCH

TECHNICAL FIELD

This invention relates to self-leveling key switches frequently having enlarged keytops.

BACKGROUND OF THE INVENTION

One of the major problems with enlarged or elongated keytops is the difficulty in providing low cost means for preventing the keytops from wobbling, shaking or tilting as they are being depressed. Such shaking or tilting frequently causes uneven wear and binding between the keystem and the supporting bearing resulting in unreliable operation and premature keyswitch failure. Such problems are normally associated with "cheap" keyswitches.

This problem has been recognized for many years with various solutions being proposed generally at the expense of additional parts and cost of manufacture. For example U.S. Pat. No. 3,916,150, granted to Lynn W. Abernethy et al. on Oct. 28, 1975, recognizes the problem and presented a possible self-leveling solution. U.S. Pat. No. 4,786,766, granted to Akihiko Kobayashi on Nov. 22, 1988, discusses the problem in more detail. Such problem and possible solutions are presented in U.S. Pat. Nos. 4,559,427 granted to Richard G. Dolson et al. on Dec. 17, 1985; 5,376,765 granted to Kirk R. Holmes et al. on Dec. 27, 1994; 4,190,748 granted to Gordon B. Langford on Feb. 26, 1980 and 5,247,143 granted to Kaname Suwa on Sep. 21, 1993.

Although some of the suggested solutions may be satisfactory under certain circumstances, the applicant has invented a very clever low cost solution that is described below.

These and other benefits and advantages of this invention may be appreciated upon reviewing the accompanying description of a preferred embodiment of this invention.

BRIEF DESCRIPTION OF THE DRAWINGS preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
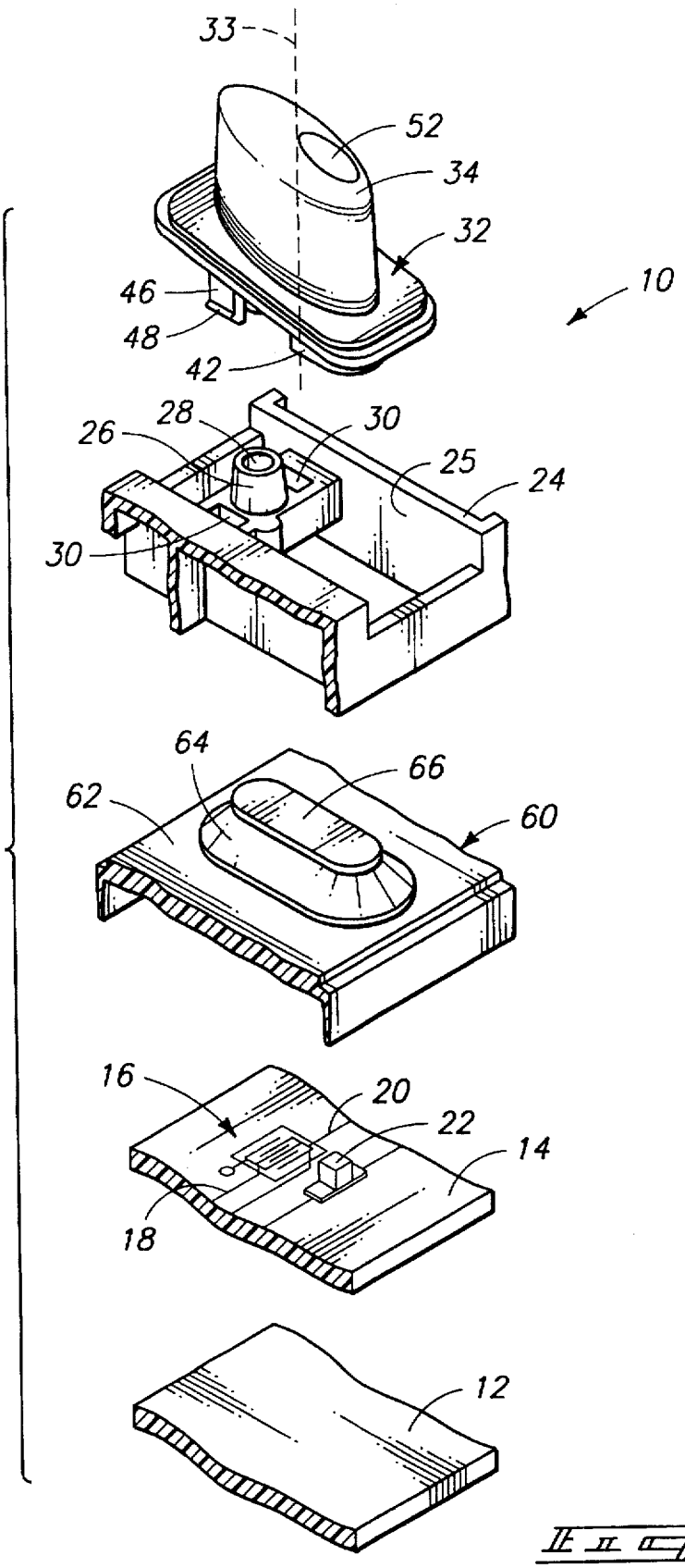
FIG. 1 is an expanded isometric view of a preferred embodiment of this invention.

Referring to the drawings, there is illustrated in FIG. 1 a preferred embodiment of a low cost self-leveling keyswitch generally designated with the numeral 10. The keyswitch 10 is designed to receive an enlarged keytop 32 that has an enlarged or elongated dimension in one lateral direction. The keyswitch 10 is designed to prevent or at least minimize wobbling, shaking or tilting of the keytop 32 as it being depressed in the actuation of the keyswitch even when the downward force applied to the keytop is off-axis.

The keyswitch 10 preferably has a backplate 12 with a rigid or flexible printed circuit board 14 supported on the backplate 12. The printed circuit board 14 has a contact structure 16 comprised of electrical switch contact pads 18 and 20 that are utilized to generate an electrical signal when the keytop 32 is properly depressed. In the preferred embodiment, the printed circuit board also has a light emitting diode 22 mounted thereon for generating a light signal.

The keyswitch 10 has a keytop support frame or housing 24 with a cavity 25 formed therein for receiving the keytop 32. The frame 24 has a keystem bearing 26 with a bearing surface 28. Additionally the frame 24 has attachment apertures 30 on opposite sides of the bearing 26 for enabling the keytop 32 to be releasably attached to the frame 24.

Figure 2:
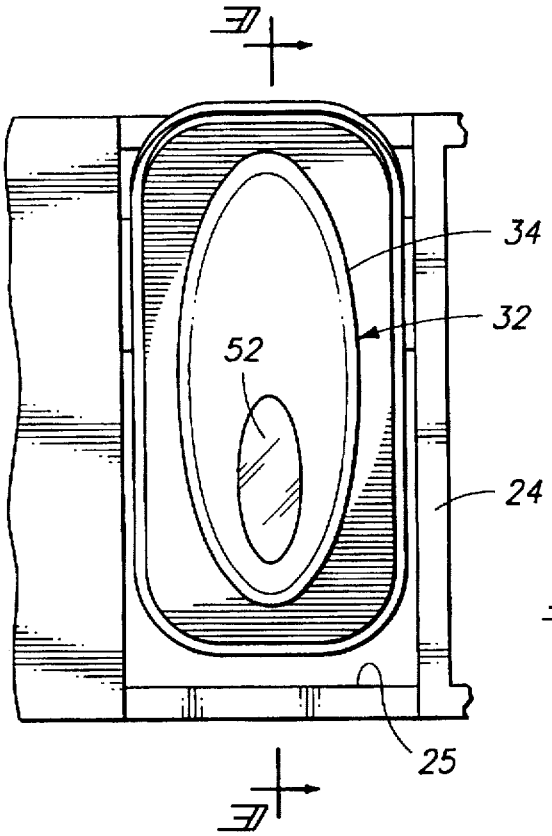
FIG. 2 is a top view of the keyswitch illustrated in FIG. 1.
Figure 3:
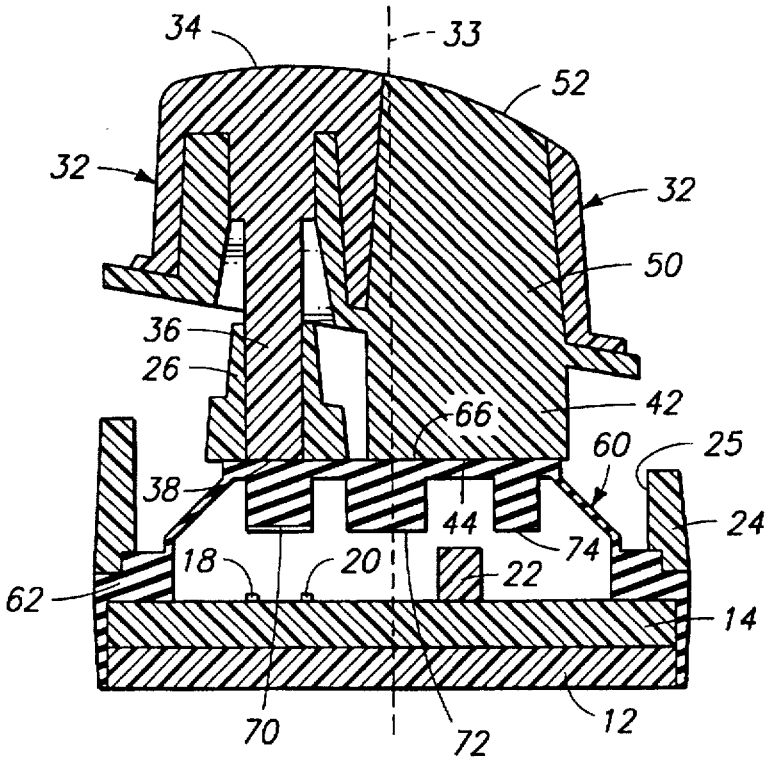
FIG. 3 is vertical cross-sectional view taken along line 3—3 in FIG. 2 showing the keytop in an un-depressed non-actuating position.
Figure 4:
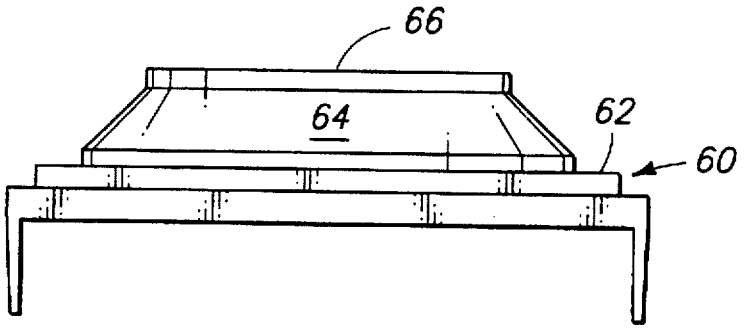
FIG. 4 is an isolated side view of an elongated elastomeric dome return spring of the keyswitch shown in FIG. 1.
Figure 5:
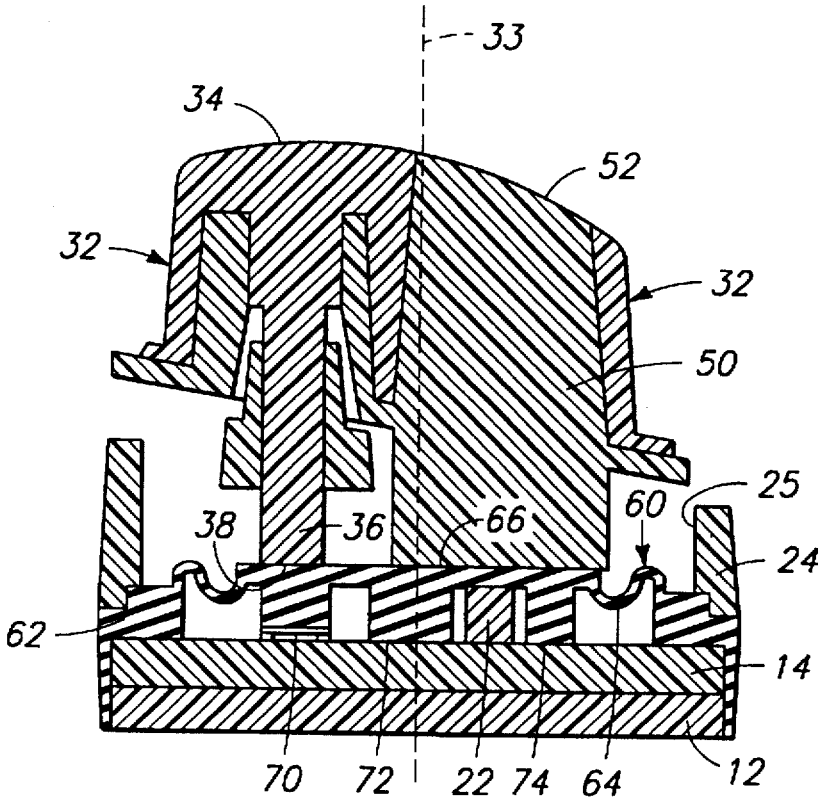
FIG. 5 is a vertical cross-sectional view similar to FIG. 3 except showing the keytop in the depressed switch actuating position.

The keytop 32 is mounted in the cavity 25 for movement along a central axis 33 between an un-depressed, non-actuating position shown in FIG. 3 and a depressed, actuating position shown in FIG. 5. The keytop 32 has a keycap 34 with an elongated shape that extends in a major dimension (length) from the central axis 33 in a first lateral direction and a minor dimension (width) from the central axis 33 in a second lateral direction which is normal to the first lateral direction. Preferably the keycap 34 has an elliptical shape as illustrated in FIG. 2 with the first lateral direction (length) extending vertical on the drawing sheet (from top to bottom).

The keytop 32 has a keystem 36 extending downward from the keycap 34 along and spaced from the central keyswitch axis 33 terminating in a keystem foot or plunger 38. The keystem 36 extends through bearing 26 with a wall that slidably engages the bearing surface 28 as illustrated in FIGS. 3 and 5.

The keytop 32 further includes a self-leveling projection 42 that extends downward from the keycap 34 along the central axis 33 laterally spaced from the keystem 36 in the length direction. The self-leveling projection 42 has a cross-section that is considerably larger than the cross-section of the keystem 36. The projection 42 terminates in a foot 44 that has a rather large footprint.

The keytop 32 further includes attachment wings 46 that extend into and slide through the attachment apertures 30 for releasably attaching the keytop 32 to the frame 24. The wings 46 have shoulders 48 for limiting the upward movement of the keytop 32 relative to the frame 24.

The keytop 32 is preferably molded using different plastic materials. A substantial portion of the keytop 32 is molded of an opaque plastic material surrounding a translucent plastic light pipe 50. The light pipe 50 transmits light from the light emitting diode 22 to a top surface 52 of the keycap 34 as a switch status indicator for the keyswitch operator. Preferably the light pipe 50 extends upward from the foot 44 of the self-leveling projection 42 to the top surface 52 of the keycap 34.

The keyswitch 10 has an elongated, preferably oval, elastomeric dome return spring 60 overlying the printed circuit electrical contact pads 18 and 20 and the light emitting diodes 22 and engaging the keystem plunger 38 and the foot 44 of the self-leveling projection 60 to spring bias the keytop 32 from the depressed position shown in FIG. 5 to the un-depressed position shown in FIG. 3. The dome return spring 60 is formed of a resilient elastomeric material that preferably is either transparent or translucent to transmit light.

The dome return spring 60 has a base portion 62 that preferably rests on the printed circuit board 14 and has an aperture surrounding the electrical contact pads 18 and 20 and the light emitting diode 22. A collapsible inclined wall portion 64 extends from the base portion 62 upward to a plateau portion 66. The plateau portion 66 is elongated having a major dimension extending laterally in the same direction as the keytop 32 as illustrated in FIGS. 3 and 5. Preferably the elongated plateau portion 66 has an oval shape as shown in FIG. 1.

The plateau portion 66 engages both the plunger 38 and the foot 44 to prevent or at least minimize tilting or wobbling of the keytop 32 as it is being moved along the central axis 33 from the undepressed position shown in FIG. 3 to the depressed position shown in FIG. 5. The contact surface of the foot 44 is greater than 25% of the top area of the plateau portion 66. Preferably the contact surface of the foot 44 is greater than 50% of the top area of the plateau portion 66 to cause the wall portion 64 of the dome return spring 60 to uniformly collapse minimizing lateral movement of the plateau portion 66 in the minor direction. The large foot 44 also enables the generation of a substantial upward force on the self-leveling projection 42 to provide smooth vertical movement of the keytop 32 along the central axis 33, independently of the location of a counter force applied on the keycap 34 to depress the keytop 32.

The elastomeric dome return spring 60 preferably has a conductive contact pill formed on the underside of the plateau portion 66 in alignment with electrical contact pads 18, 20 on the printed circuit board 14 so that when the dome return spring collapses, the button 70 engages both of the pads 18, 20 to bridge the contact pads 18, 20 and provide electrical continuity (close the switch) and generate an electrical signal. Preferably the keystem 36, the button 70 and the pads 18, 20 are in vertical alignment.

Additionally, the elastomeric dome return spring 60 has spaced resilient stop elements 72 and 74 formed on the underside of the plateau portion 66 to limit the downward movement of the plateau portion 66 as the wall portion 64 collapses. Such a feature provides for a uniform tactile feel between multiple keyswitches in the same structure such as a control panel or keyboard.

Should the subject keyswitch be incorporated in a multi-keyswitch apparatus, it may be desirable to include the elongated elastomeric dome return spring 60 in a multi-dome elastomeric sheet.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A self-leveling keyswitch, comprising:

an elongated keytop having a major dimension in a lateral direction from a central axis;

said elongated keytop having a keystem that extends outward from the keytop along but spaced from the central axis in the lateral direction;

said elongated keytop having a self-leveling projection that extends outward from the keytop along the central axis but spaced from the keystem in the lateral direction;

a keytop support means having a bearing surface that slidably receives the keystem to enable the keytop to move parallel with the central axis between an un-depressed, non-actuating position and a depressed, actuating position;

a printed circuit having electrical switch contacts that are actuated when the keytop is moved to the depressed position; and an elongated elastomeric dome return spring having a major dimension in the lateral direction sufficient to receive and spring bias both the keystem and self-leveling projection along the central axis from the depressed position to the un-depressed position.

2. The self-leveling keyswitch as defined in claim 1 wherein the printed circuit has a light emitting diode therein aligned with the self-leveling projection and wherein the self-leveling projection is formed, at least in part, of translucent material to transmit light emitted from the light emitting diode to the keytop.

3. The self-leveling keyswitch as defined in claim 1 wherein the keytop has an elliptical shape having a major dimension in the lateral direction.

4. The self-leveling keyswitch as defined in claim 1 wherein the dome return spring has an oval shape elongated in the lateral direction.

5. The self-leveling keyswitch as defined in claim 1 wherein the elongated elastomeric dome return spring has a support base portion and an inclined wall portion that extends upward to an elongated plateau portion that receives both the keystem and the self-leveling projection.

6. The self-leveling keyswitch as defined in claim 5 wherein the elongated plateau portion of the dome return spring has a prescribed top surface area and wherein the self-leveling projection has a prescribed foot area that engages the dome return spring wherein the predescribed foot area is greater than 25% of the prescribed top surface area of the plateau portion.

7. The self-leveling keyswitch as defined in claim 6 wherein the prescribed foot area of the self-leveling projection is greater than 50% of the prescribed top surface area of the plateau portion.

8. The self-leveling keyswitch as defined in claim 1 wherein the printed circuit has two spaced electrical contact pads and wherein the dome return spring has a conductive contact pill on an underside thereof that engages the two electrical contact pads when the keytop is depressed to actuate the keyswitch.

9. The self-leveling keyswitch as defined in claim 8 wherein the dome return spring has a stop means on an underside thereof that limits the movement of the dome return spring when the keytop is depressed.

* * * * *

UNITED STATES PATENT AND TRADEMARK OFFICE

CERTIFICATE OF CORRECTION

PATENT NO. : 5,743,384

DATED : April 28, 1998

INVENTOR(S) : Neal S. Clark

It is certified that error appears in the above-identified patent and that said Letters Patent is hereby corrected as shown below:

On the title page:

Replace

"[22] Filed: May 9, 1997"

with

--[22] Filed: May 8, 1997--.

Signed and Sealed this

Twenty-third Day of March, 1999

*Attest:*

Q. TODD DICKINSON

*Attesting Officer*

*Acting Commissioner of Patents and Trademarks*